US005575618A

United States Patent [19]

Brandon et al.

[11] Patent Number: 5,575,618

[45] Date of Patent: Nov. 19, 1996

[54] STEAM TURBINE STEAM STRAINER

[76] Inventors: Ronald E. Brandon, 652 Jubilee St., Melbourne, Fla. 32940; David E. Brandon, 2166 E. Hampton Rd., Binghamton, N.Y. 13903

[21] Appl. No.: 562,707

[22] Filed: Nov. 27, 1995

Related U.S. Application Data

[63] Continuation-in-part of Ser. No. 344,862, Nov. 25, 1994, Pat. No. 5,486,088.

[51] Int. Cl.[6] ..... F03B 11/08

[52] U.S. Cl. ..... 415/121.2; 55/467; 137/549

[58] Field of Search ..... 415/121.2; 55/467; 137/625.3, 549

[56] References Cited

U.S. PATENT DOCUMENTS

| | | | |
|---|---|---|---|
| 3,044,484 | 7/1962 | Dunning | 137/549 |
| 4,024,891 | 5/1977 | Engel et al. | 137/625.3 |
| 4,077,739 | 3/1978 | Heilenbach | 415/121.2 |
| 4,134,425 | 1/1979 | Güssefeld et al. | 137/625.3 |
| 5,014,746 | 5/1991 | Heyman | 137/625.3 |
| 5,088,518 | 2/1992 | Stamatakis et al. | 137/549 |
| 5,372,730 | 12/1994 | Warner et al. | 415/121.2 |
| 5,486,088 | 1/1996 | Brandon | 415/121.2 |

FOREIGN PATENT DOCUMENTS

| | | | |
|---|---|---|---|
| 0525366 | 2/1993 | European Pat. Off. | 55/467 |

*Primary Examiner*—Edward K. Look
*Assistant Examiner*—Mark Sgantzos
*Attorney, Agent, or Firm*—Ross, Ross & Flavin

[57] ABSTRACT

In a steam turbine inlet which includes an annular steam strainer stationarily positioned therein for stopping the passage into the turbine of large metal particles in the steam, the improvement in the strainer which comprises a plurality of spaced through holes in a major portion of the strainer circumference, the through holes being of differing diameters, with holes of like diameter being positioned in longitudinally-extending, circumferential zones, holes of the largest diameter being disposed in zones where metal particles are least likely to enter the holes, holes of smaller diameter being disposed in zones where metal particles are most likely to enter the holes, and a longitudinally-extending, circumferential zone in the strainer without holes where the particles velocity and direction of movement would be damaging to any holes located in such a zone, the through holes each having an entrance end on the outer periphery of the strainer, an exit end on the inner periphery of the strainer, and an interior portion disposed between the entrance end and exit end, the exit end having a larger diameter than the interior portion to reversably slow steam velocity and decrease steam pressure drop.

5 Claims, 2 Drawing Sheets

STEAM TURBINE STEAM STRAINER

This is a continuation-in-part of application Ser. No. 08/344862 filed Nov. 25, 1994, now U.S. Pat. No. 5,486, 088.

BACKGROUND OF THE INVENTION

1. Field of the Invention

This invention relates to steam turbines and the devices used to stop large particles carried by the inlet steam from entering the turbine.

2. Description of the Prior Art

All steam turbines include strainers to capture particles carried by steam from the boiler and to prevent the particles from entering the turbine where serious damage could occur.

Existing turbines use one of two general types of strainers.

The first type is a cylinder with large holes that are arranged to permit a screen with smaller openings to be wrapped around the cylinder, thus having the ability to stop steam carried particles larger than approximately ⅛ inch in size. This same system can also permit the temporary addition of a finer mesh screen for brief operating periods when the presence of particles from the boiler is known to be a serious threat. This type of strainer presents a minor deficiency in that the screen itself may fail with time and operating use thus causing internal turbine damage of a serious nature. The steam pressure drop is also increased by the necessity of passing through both a screen and the strainer holes.

The second type of strainer is a simple cylinder with many small holes. The holes allow the passage of steam, but stop particles larger than the hole size selected. The holes selected vary from one turbine design to another, with some designers selecting approximately ¼ inch holes; while others use approximately 3/32 inch holes. This type strainer uses holes with square,sharp inlets, such that the flow coefficient is relatively small, causing a greater pressure drop of the steam entering the turbine. These holes are further vulnerable to inlet damage caused by high velocity particles which further reduces the effective flow area and increases the undesirable steam pressure drop.

SUMMARY OF THE INVENTION

It is the purpose of the invention to eliminate the risk of screen failures present in the first type of strainer described above; further, to reduce the maximum size of particle that will pass through the strainers; and still further, to reduce the operating pressure drop required of the steam flow in any of the strainers. And, additionally, to simplify the use and maintenance of the strainers.

DESCRIPTION OF THE PREFERRED EMBODIMENTS

Figure 1:
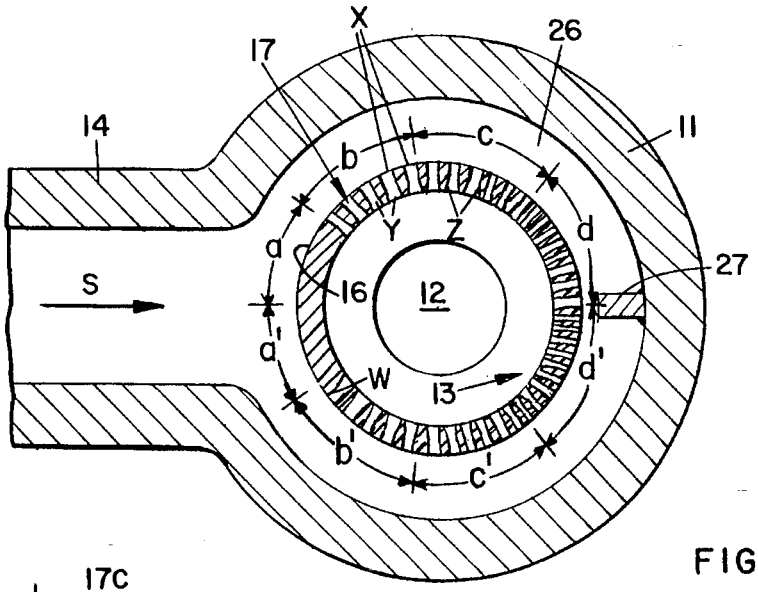
FIG. 1 is a fragmentary, cross-sectional plan view of a strainer embodying the invention mounted in a turbine stop valve casing.

FIG. 1 is a fragmentary cross sectional plan view of a turbine stop valve casing 11. Entering the valve casing is a steam entry line 14 with the direction of steam flow shown by arrow S.

Contained inside casing 11 is a cylindrical steam strainer 13 embodying a preferred form of the invention and having a plurality of rows of spaced parallel holes, generally indicated by 17 which extend horizontally through the strainer wall.

All steam must pass through holes 17 in the strainer wall, the purpose of the holes being to stop the passage of large metallic particles from the boiler, not shown, into the turbine, also not shown.

After passage through holes 17 in strainer 13, the steam flows through a valve discharge pipe 12, and then into the turbine, not shown. Flow is prevented from by-passing the strainer by metal-to-metal contact at both ends of the strainer by a valve casing cover (not shown) at the strainer upper end and by the inside of the valve casing at the strainer lower end.

An annular passage 26 in casing 11 surrounds strainer 13 and allows steam to flow between the valve casing and strainer so as to permit steam access to all the holes 17 in the strainer. A partial blockage of the annular passage 26 is provided by an abutment 27 disposed opposite steam entry line 14 to minimize circulation of steam or particles.

Figure 4:
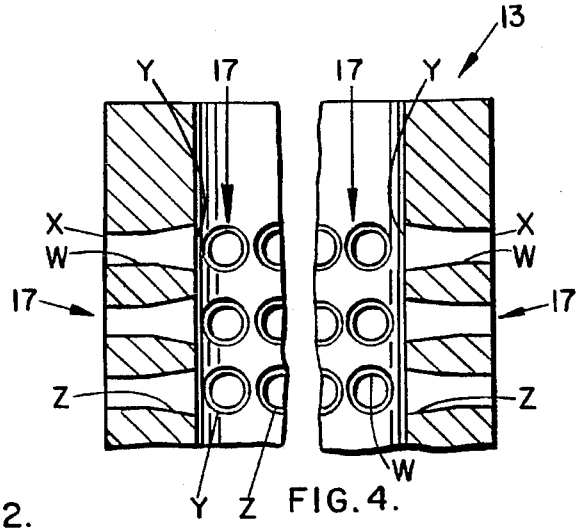
FIG. 4 is an enlarged, fragmentary, broken cross sectional view taken transversely through the strainer of FIG. 2.

As best seen in FIG. 4, each hole 17 includes an outer or entrance end X at the outer periphery of the strainer wall, an inner or discharge end Y at the inner periphery of the strainer wall, and an interior portion W disposed centrally between entrance end X and discharge end Y.

The diameter of each hole 17 is substantially constant from entrance end X to a location approximately centrally of the length of interior portion W where it is provided with an ever increasing taper Z at its inner end to provide a bell-like shape to inner or discharge end Y, wherefore the hole diameter is larger at discharge end Y than it is at interior portion W.

This configuration of holes 17 reduces pressure drop of the steam passing through strainer 13, with taper Z leading to discharge ends Y creating a diffusing passage.

The purpose of the diffusing passage is to reversably slow the steam velocity at the discharge ends of the holes causing the steam pressure to rise. This decreases the pressure drop in holes 17 and also decreases the pressure drop required to turn the flow 90°, so as to be directed toward the turbine stop valve, not shown. This results in improved turbine performance.

The amount of taper Z to holes 17 and the angle can be varied to suit the desired application. One suggested half angle of taper is 3.5°, with the length of the taper being enough to increase the flow area of the hole by a factor of 2.

Figure 2:
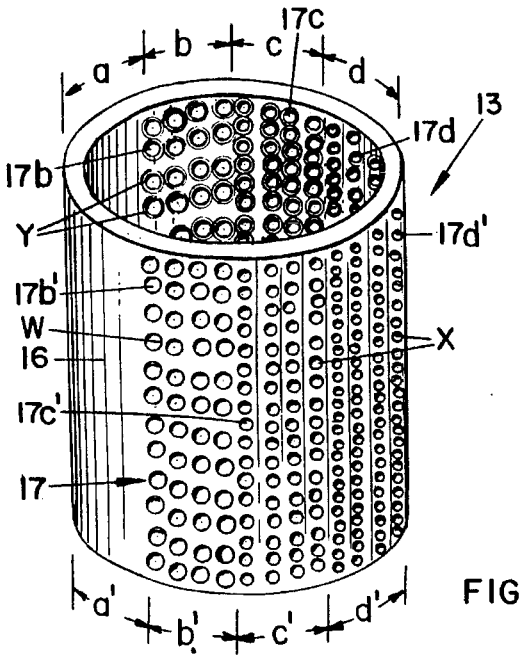
FIG. 2 is a perspective view of the strainer of FIG. 1.

FIG. 2 is a perspective view of cylindrical steam strainer 13. Holes 17 are provided in a major portion of the circumference of the strainer wall. However, a portion 16 of the strainer where high velocity steam from steam entry line 14 impacts the strainer is not provided with holes in a longitudinally-extending, circumferential zone identified by the letters a and a'.

Holes 17*b*–17*d* of varying diameters are provided in spaced, longitudinally-extending, circumferential zones b–d and holes 17*b*'–17*d*' of varying diameters are provided in spaced, longitudinally-extending, circumferential zones b'–d' throughout the remainder of the strainer circumference.

In zones b and b', located on either side of portion 16 and zones a and a' respectively, holes 17*b* and 17*b*' are relatively large in the order of ¼ inch diameter.

In zones c and c', located on either side by zones b and b' respectively, holes 17*c* and 17*c*' are slightly smaller and are of medium size in the order of ⅛ inch diameter.

In zones d and d' located on either side of zones c and c' respectively, small holes 17*d* and 17*d*' are provided, in the order of 3/22 inch diameter.

Figure 3:
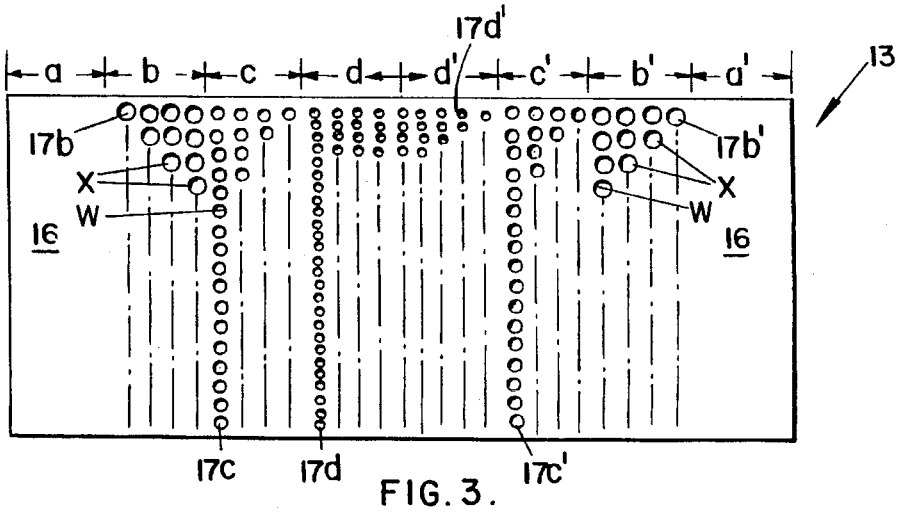
FIG. 3 is a plan view of the strainer of FIG. 2 shown in an unrolled or flat condition.

The relationship of the various zones a–d and a'–d' is graphically displayed in FIG. 3, wherein the strainer wall is laid flat.

With this zoned arrangement, relatively large holes 17*b* and 17b' are used in zones b and b' where the particles have little chance of entry, while small holes 17*d* and 17*d*' are used in zones d and d' where the bouncing particles have the best chance of entry. The particles adjacent to zones b and b' are traveling through annular passage 26 in a direction generally perpendicular to the axes of holes 17. The particles adjacent to zones d and d' are bouncing and being stirred by the steam to be moving in random directions; thus, the particles are more likely to enter holes 17 in these zones, especially if these holes are large.

Figure 6:
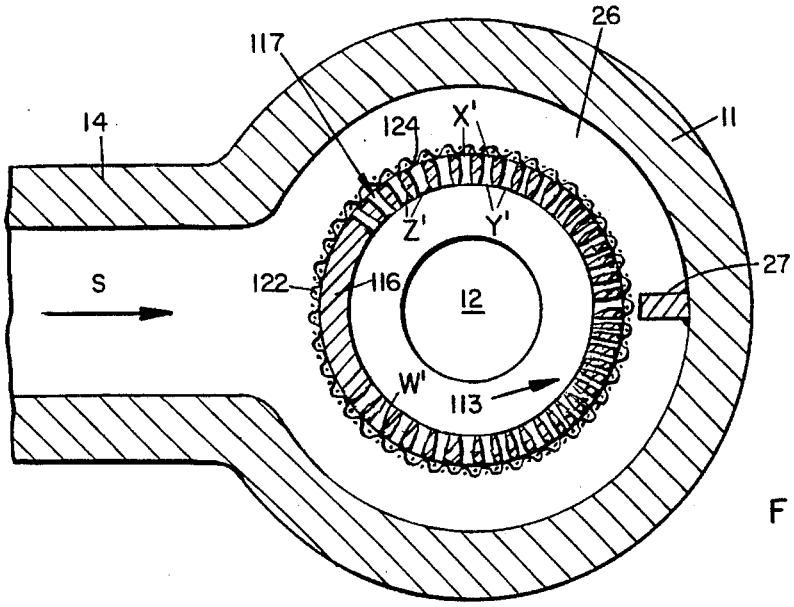
FIG. 6 is a fragmentary, cross-sectional plan view of the modified strainer of FIG. 5 mounted in a turbine stop valve casing.
Figure 5:
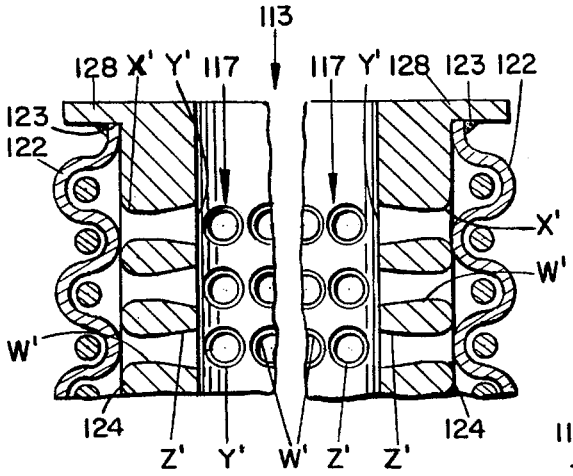
FIG. 5 is an enlarged fragmentary, broken cross sectional view taken transversely through a modified form of strainer.
Figure 7:
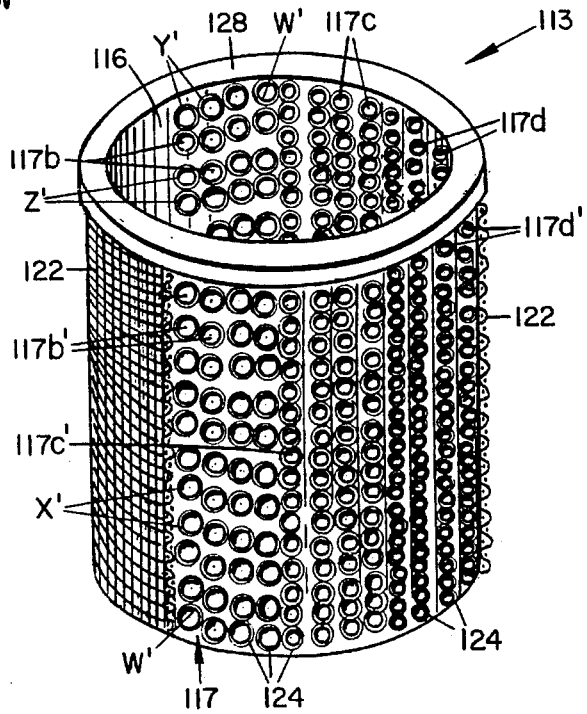
FIG. 7 is a perspective view of the modified strainer of FIG. 5 with the screen broken away for clarity.

FIGS. 5–7 illustrate a strainer 113 embodying a modified form of the invention.

In this embodiment, a fine mesh screen 122 is fixed to the outer periphery of strainer 113 at its inlet as by welding at 123, and/or by rivets or bolts, not shown; and strainer 113 replaces strainer 13 centrally of casing 11.

Strainer 113 with its mesh screen 122 is used during temporary operating periods when particles from the boiler are most probable. A shoulder 128 protects the mesh screen.

As with strainer 13 of FIGS. 1–4, holes 117 are provided in a major portion of the circumference of strainer 113. However, a longitudinally-extending, circumferential portion or zone 116 of the strainer where high velocity steam from steam entry line 14 impacts the strainer is not provided with holes.

In strainer 113, holes 117*b*–117*d* and holes 117*b*'–117*d*' of varying diameters are provided in spaced, longitudinally-extending, circumferential zones throughout the remainder of the strainer wall.

As best seen in FIG. 5, holes 117 are rounded as at 124 at outer entrance ends X' at the outer periphery of the strainer wall to minimize steam pressure drop and also to minimize damage to the hole caused by particle impact.

Each hole 117 additionally includes an inner or discharge end Y' at the inner periphery of the strainer wall, and an interior portion W' disposed centrally between entrance end X' and discharge end Y'.

The diameter of each hole 117 is substantially constant from rounded entrance end X' to a location approximately centrally of the length of interior portion W' where it is provided with an ever increasing taper Z' at its inner end to provide a bell-like shape to inner or discharge end Y', wherefore the hole diameter is larger at discharge end Y' than it is at interior portion W'.

As with the embodiment of FIGS. 1–4, this configuration of holes 117 reduces pressure drop of the steam passing through strainer 113, with taper Z' leading to discharge ends Y' creating a diffusing passage, the purpose of which is to reversably slow the steam velocity at the discharge ends of the holes causing the steam pressure to rise. This decreases the pressure drop in holes 117 and also decreases the pressure drop required to turn the flow 90°, so as to be directed toward the turbine stop valve, not shown. This results in improved turbine performance.

It is to be noted that steam strainers of the invention are applicable to both high pressure and reheat turbine inlets.

We claim:

1. In a steam turbine inlet which includes an annular steam strainer stationarily positioned therein for stopping the passage into the turbine of large metal particles in the steam, the improvement in the strainer which comprises:

a plurality of spaced through holes in a major portion of the strainer circumference, the through holes being of differing diameters, with holes of like diameter being positioned in longitudinally-extending, circumferential zones, holes of the largest diameter being disposed in zones where metal particles are least likely to enter the holes, holes of smaller diameter being disposed in zones where metal particles are most likely to enter the holes, and a longitudinally-extending, circumferential zone in the strainer without holes where the particle velocity and direction of movement would be damaging to any holes located in such a zone, the through holes each having an entrance end on the outer periphery of the strainer, an exit end on the inner periphery of the strainer, and an interior portion disposed between the entrance end and exit end, the exit end having a larger diameter than the interior portion to reversably slow steam velocity and decrease steam pressure drop.

2. In an improved strainer according to claim 1, the interior portion of each through hole being tapered for a portion of its length, with the taper terminating at the exit end.

3. In an improved strainer according to claim 2, wherein the half angle of taper is 3.5°, with the length of the taper being sufficient to increase the flow area of the holes by a factor of 2.

4. In an improved strainer according to claim 1, wherein a fine mesh screen is positioned outwardly of and protects the zoned holes.

5. In an improved strainer according to claim 1, wherein the holes have rounded entrance ends to minimize steam pressure drop and particle damage to the holes.

* * * * *